US007077487B2

(12) United States Patent
Yang

(10) Patent No.: US 7,077,487 B2
(45) Date of Patent: Jul. 18, 2006

(54) DRAWER RAIL WITH AUTO-RETURNING DEVICE

(76) Inventor: Jun-Long Yang, No. 33, Da-Hsin 15 St., Tai-Ping City, Taichung Hsien (TW)

( * ) Notice: Subject to any disclaimer, the term of this patent is extended or adjusted under 35 U.S.C. 154(b) by 164 days.

(21) Appl. No.: 10/784,239

(22) Filed: Feb. 24, 2004

(65) Prior Publication Data

US 2005/0184629 A1 Aug. 25, 2005

(51) Int. Cl.
*A47B 88/00* (2006.01)

(52) U.S. Cl. ..... 312/333; 312/319.1; 312/334.47

(58) Field of Classification Search ..... 312/319.1, 312/333, 334.44, 334.46, 334.47; 384/21
See application file for complete search history.

(56) References Cited

U.S. PATENT DOCUMENTS

| | | | | |
|---|---|---|---|---|
| 5,302,016 | A * | 4/1994 | Lautenschlager et al. | 312/333 |
| 6,652,050 | B1 * | 11/2003 | Lin | 312/333 |
| 6,733,097 | B1 * | 5/2004 | Kim et al. | 312/333 |
| 6,799,817 | B1 * | 10/2004 | Chu | 312/333 |
| 6,848,759 | B1 * | 2/2005 | Doornbos et al. | 312/319.1 |
| 2004/0000850 | A1 * | 1/2004 | Lam Harn et al. | 312/333 |
| 2004/0183411 | A1 * | 9/2004 | Boks | 312/333 |
| 2004/0227438 | A1 * | 11/2004 | Tseng et al. | 312/333 |
| 2004/0239218 | A1 * | 12/2004 | Jurja | 312/333 |
| 2005/0093406 | A1 * | 5/2005 | Yang | 312/333 |
| 2005/0104492 | A1 * | 5/2005 | Chiu | 312/333 |

FOREIGN PATENT DOCUMENTS

| | | | |
|---|---|---|---|
| EP | 391221 | * 10/1990 | 312/333 |

* cited by examiner

*Primary Examiner*—Lanna Mai
*Assistant Examiner*—Hanh V. Tran
(74) *Attorney, Agent, or Firm*—Fei-Fei Chao; Bingham McCutchen LLP

(57) ABSTRACT

A drawer rail having an auto-returning device has an outer track, an inner track, a driving block formed on the outer/inner track and a base mounted on the opposite inner/outer track. The base has a spring recess and a block recess with a positioning cutout to respectively receive a spring and a sliding block. The sliding block is pulled by the spring. An elongated through hole is defined in the block recess to allow parts of the sliding block to penetrate to engage with the driving block. When the outer/inner track moves away, the sliding block is pushed by the driving block to bias at the positioning cutout to allow the driving block to release from the sliding block. When the outer/inner track moves near, the driving block urges the sliding block back to a horizontal place and the spring pulls the sliding block back to an original position automatically.

10 Claims, 8 Drawing Sheets

DRAWER RAIL WITH AUTO-RETURNING DEVICE

BACKGROUND OF THE INVENTION

1. Field of the Invention

The present invention relates to a drawer rail with an auto-returning device, and particularly to a drawer rail that moves stably and is automatically returned to an original place to keep a drawer closed.

2. Description of Related Art

To keep a drawer closed when not in use, an auto-returning device with a spring is mounted on a drawer rail to provide an auto-returning restituting efficiency to the drawer. However, a conventional auto-returning device has complex elements and has a high production cost which result in a high overall price for such a drawer. Therefore, consumers do not choose the drawer having the auto-returning device based on a consideration of the high price. Additionally, the conventional auto-returning device is not stable and the drawer derails easily, causing inconvenience and irritation to the user.

To overcome the shortcomings of the conventional auto-returning device, the present invention provides a drawer with a modified auto-returning device for drawer rail to mitigate and obviate the aforementioned problems.

SUMMARY OF THE INVENTION

The main objective of the invention is to provide a drawer rail with an auto-returning device that moves stably to reduce malfunction and automatically pulls the drawer rail back.

Other objectives, advantages and novel features of the invention will become more apparent from the following detailed description when taken in conjunction with the accompanying drawings.

DETAILED DESCRIPTION OF THE PREFERRED EMBODIMENT

A drawer rail with an auto-returning device in accordance with the present invention comprises:

a track assembly composed of an inner track and an outer track;

a driving block formed on the inner track or the outer track;

a base movably mounted on the inner track or the outer track opposite to the driving block, wherein, the base has a front end, a rear end, two sides, a spring recess defined in the rear end for accommodating a spring, a block recess defined in the front end to communicate with the spring recess, an elongated through hole defined in the block recess through the base, and a positioning cutout with a stub notch defined in one side close to the spring recess; and a sliding block movably accommodated inside the block recess and having an abutting face with a top edge and bottom edge facing to the block recess, an extending portion protruding from the abutting face at the top edge to penetrate the elongated through hole in the base, a limiting cutout defined in the extending portion to receive the driving block, a spring post formed on the abutting face close to the bottom edge at one end near the spring recess, and a stub formed on the abutting face close to the bottom edge at the other end opposite to the spring post.

When the outer track moves away from the inner track, the spring is extended by force to store restitution force and the driving block engages with the limiting cutout to drive the sliding block to move until the sliding block biases to fall into the positioning cutout on the base. Meanwhile, the limiting cutout of the sliding block is inclined and then the driving block is released from the limiting cutout to further move forward. On the contrary, when the outer track moves toward the inner track, the driving block enters the inclined limiting cutout to urge the sliding block back to a horizontal place. Lastly, the spring pulls the sliding block back to the original position by the restitution force.

Figure 1:
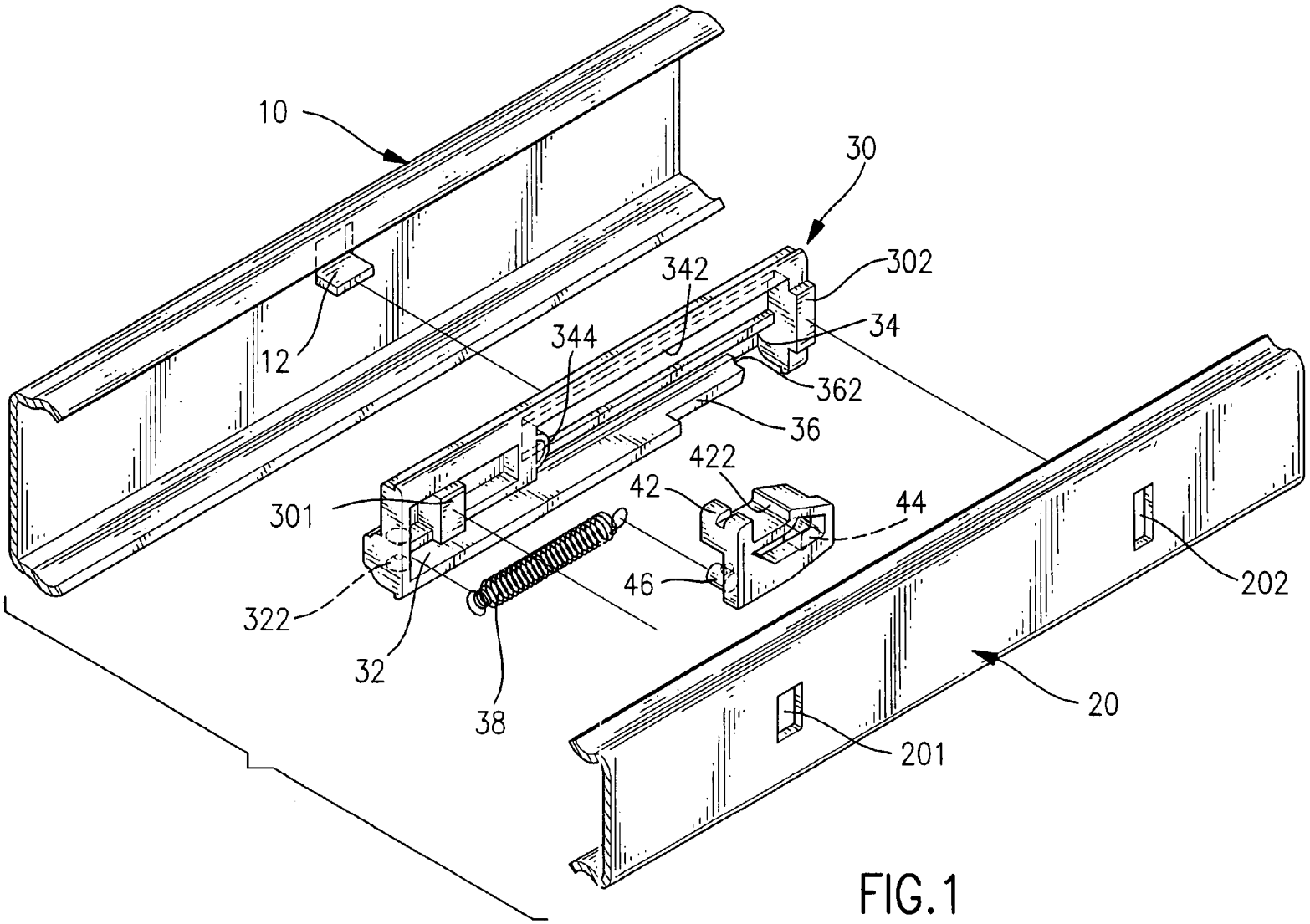
FIG. 1 is an exploded perspective view of a first embodiment of a drawer rail with an auto-returning device in accordance with the present invention.
Figure 2:
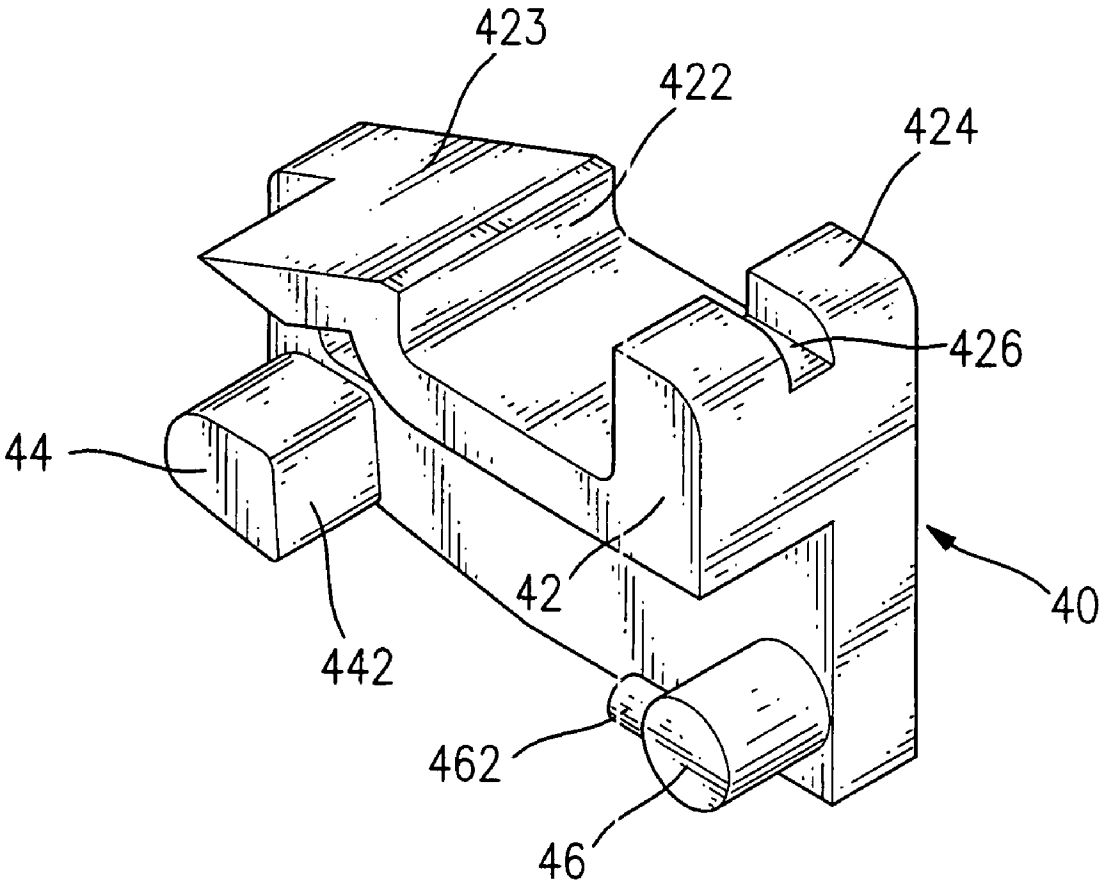
FIG. 2 is an enlarged perspective view of a sliding block in FIG. 1.
Figure 3:
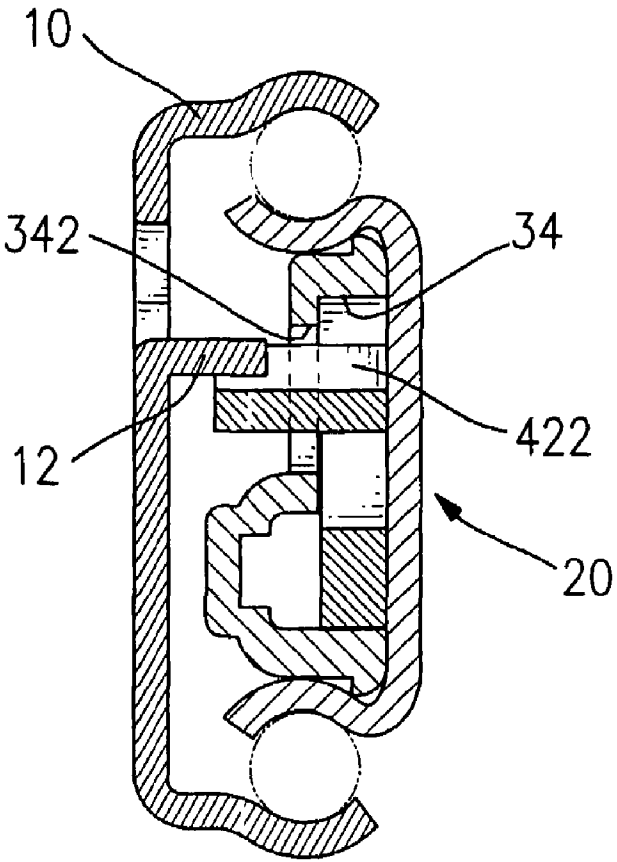
FIG. 3 is an enlarged cross-sectional end plan view of the drawer rail with an auto-returning device according to line 3—3 in FIG. 4.

With reference to FIGS. 1 to 3, the drawer rail with an auto-returning device is attached on an inner track (20) of a track assembly and comprises a driving block (12) formed on an outer track (10) of the track assembly, a base (30) mounted on the inner track (20), a sliding block (40) movably attached to the base (30), and a spring (38) accommodated inside the base (30) to pull the sliding block (40).

The outer track (10) of the track assembly is immovably attached on an inner side of a compartment for accommodating a drawer. The inner track (20) of the track assembly is immovably attached on an outer side of the drawer and slidably engages with the outer track (10). Preferably, a ball bearing race (not numbered) is clamped between the outer track (10) and the inner track (20) for smooth movement of the inner track (20) relative to the outer track (10).

The driving block (12) extends from a bottom side of the outer track (10) in a direction toward the inner track (20) by punching the bottom side of the outer track (10).

The base (30) is a substantially rectangular body and has a front face, a rear face, a top edge, a bottom edge, a first end, a second end opposite to the first end, a spring recess (32), a block recess (34), and a positioning cutout (36). The spring recess (32) is defined in the front face near the bottom edge and extends from the first end to the second end. The block recess (34) with a bottom is defined in the front face near the top edge on the second end and communicates with the spring recess (32). An elongated hole (342) is defined in the bottom of the block recess (34). Preferably, the block recess (34) has an inner sidewall and a bumper (344) is formed on the inner sidewall to abut against the sliding block (40). The positioning cutout (36) is defined in the bottom edge near the second end and further has stub notch (362) defined in the positioning cutout (36). Additionally, two wedges (301, 302) are respectively formed on the front face at the first end and the second end of the base (30) to respectively engage two mortises (201, 202) defined in the inner track (20).

The spring (38) with an immovable end and a free end has a neck formed at the immovable end and a hook formed at the free end. The spring recess (32) of the base (30) further has two opposite inner sidewalls and a pair of cone-shaped nubs (322) formed on the two opposite inner sidewalls to clamp the spring (38) at the neck.

The sliding block (40) is movably mounted on the base (30) and has a particular structure as shown in FIG. 2. The sliding block (40) has a front face, a rear face, a top edge, a bottom edge, a first end, a second end opposite to the first end, an extending portion (42) with a limiting cutout (422), a spring post (46), and a stub (44). The extending portion (42) with a top face extends from the rear face at the top edge toward to the base (30) and penetrates the elongated through hole (342) in the block recess (34). The limiting cutout (422) is defined in the top face of the extending portion (42) to accommodate the driving block (12) inside when the sliding block (40) is mounted on the base (30). Additionally, an optional inclined face (423) is formed on the first end that is away from the spring recess (32) to provide a guiding efficiency to the driving block (12) for disengaging from or engaging with the limit cutout (422). An optional guard wall (424) is formed on the extending portion (42) at the top edge of the sliding block to prevent the driving block (12) rushing over the limiting cutout (422). Moreover, a slit (426) is defined longitudinally in the guard wall, which engages with the wall of the elongated through hole (342) to keep the sliding block (40) stable inside the block recess (34).

Additionally, the stub (44) is formed on the rear face near the bottom edge at the first end to engage with the stub notch (362) in the positioning cutout (36). The stub (44) has an outer periphery and a flat face (442) defined in the outer periphery facing to the second end of the sliding block (40) to abut against an inner flat wall of the stub notch (362). Therefore, the stub (44) is not easily disengaged from the stub notch (362). The spring post (46) is formed on the rear face at the second end near the bottom edge to engage with the hook of the spring (38). Furthermore, the spring post (46) further has an outer periphery and a blocking pin (462) formed on the outer periphery and perpendicular to the spring post (46) to prevent the hook of the spring (38) sliding out of the spring post (46).

Figure 4:
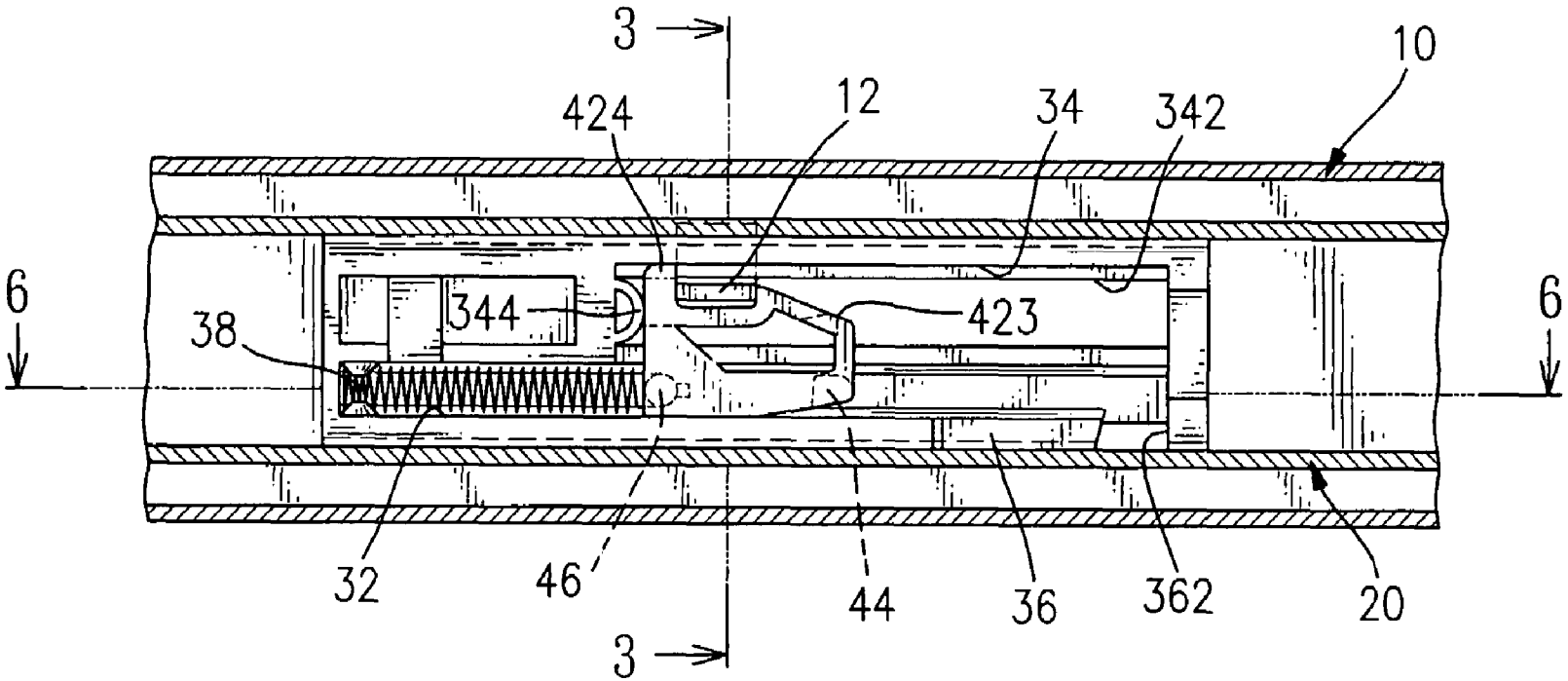
FIG. 4 is an enlarged top plan view in partial section of the drawer rail with an auto-returning device.
Figure 5:
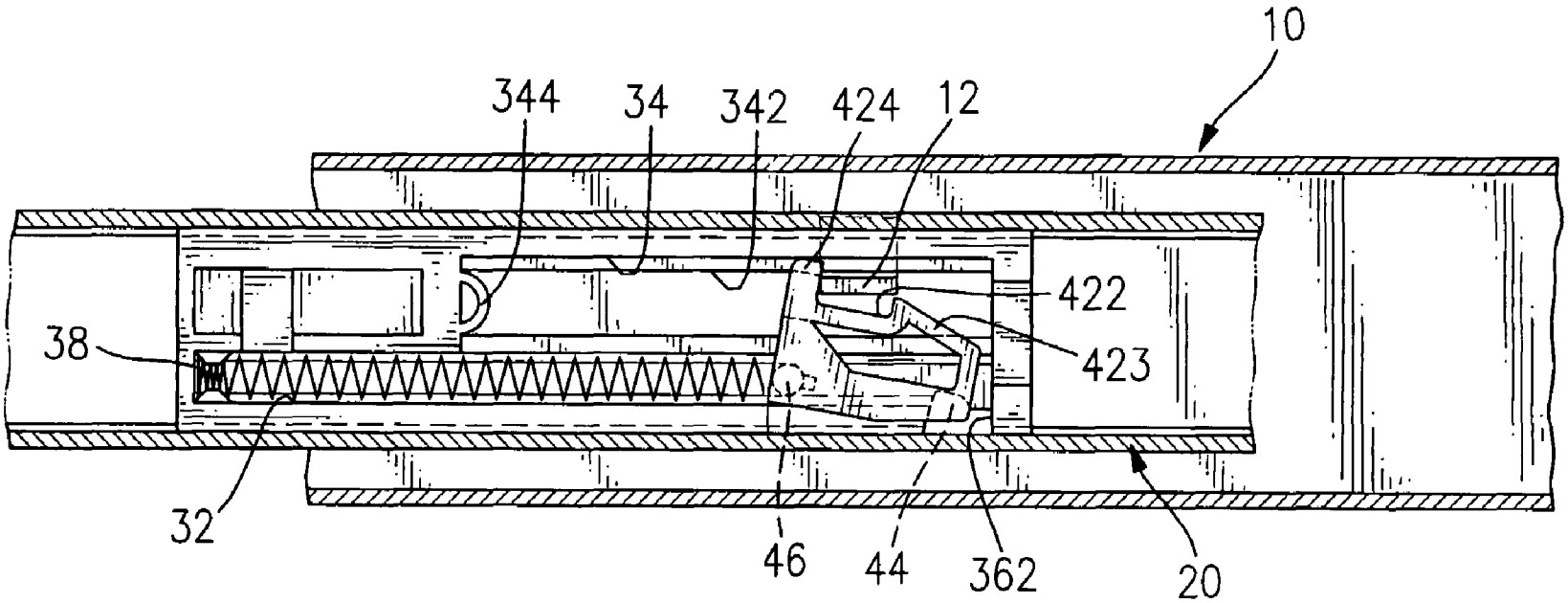
FIG. 5 is an operational top plan view in partial section of the drawer rail with an auto-returning device in FIG. 4 where the sliding block is biased.
Figure 6:
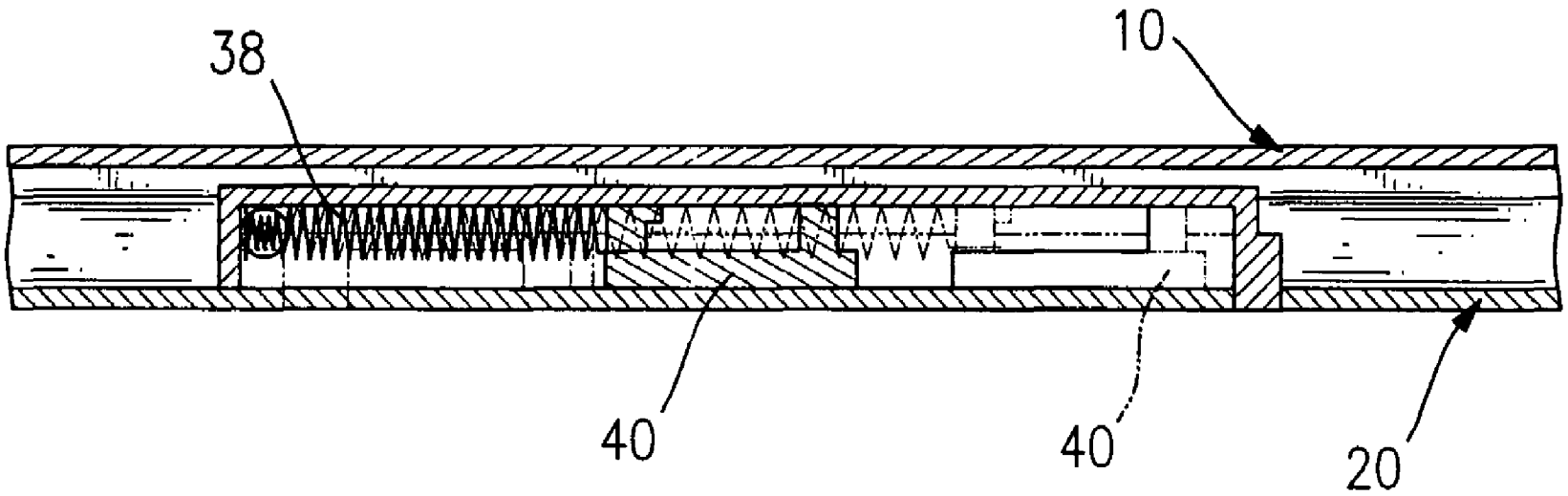
FIG. 6 is an enlarged side plan view in partial section of the drawer rail with an auto-returning device according to line 6—6 in FIG. 4.

The arrangement of the base (30), the spring (38) and the sliding block (40) all attached on the track assembly is shown in FIGS. 4 to 6. When the inner track (20) moves away of the outer track (10), the driving block (12) blocks the sliding block (40) to make the spring (38) extend because the base (30) is moving along with the inner track (20) and the sliding block (40) is kept still. Until the sliding block (40) aligns with the positioning cutout (36), the sliding block (40) is biased by a pulling force from the spring (38) to lean to the positioning cutout (36). Meanwhile, the limiting cutout (422) is also inclined to release the driving block (12) from the first end of the sliding block (40) so that the inner track (40) is enabled to keep going forward. On the contrary, when the inner track (20) moves close to the outer track (10), the driving block (12) enters the limiting cutout (422) again and presses the guard wall (424) to arrange the driving block (12) to a horizontal position. Thereby, the sliding block (40) disengages from the positioning cutout (36) and is pulled back by the extended spring (38).

Figure 7:
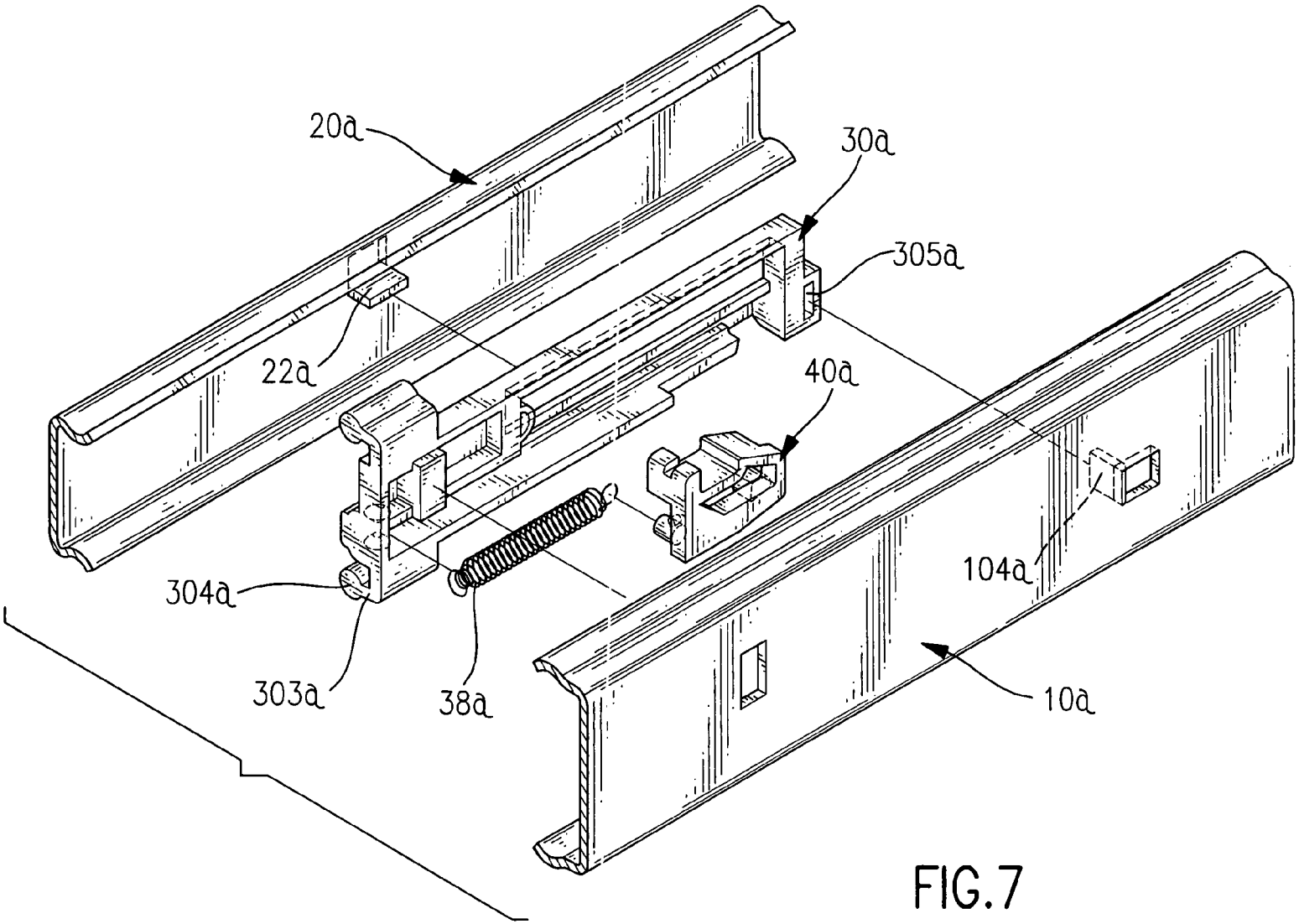
FIG. 7 is an exploded perspective view of a second embodiment of the drawer rail with an auto-returning device in accordance with the present invention.
Figure 8:
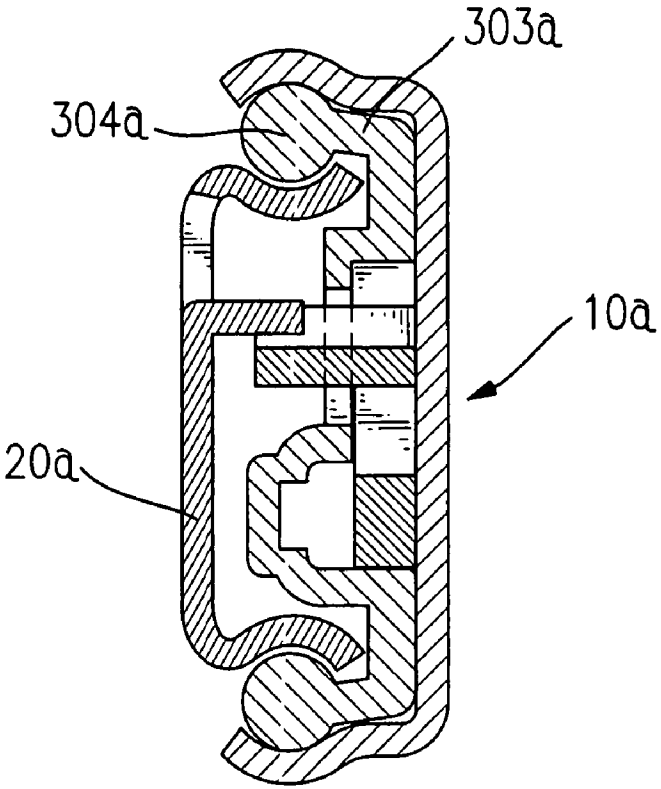
FIG. 8 is an enlarged cross-sectional end plane view of the second embodiment of the drawer rail with an auto-returning device in FIG. 7.

A second embodiment of the drawer rail with an auto-returning device in accordance with the present invention is attached on an outer track (10*a*) of a rail assembly as shown in FIGS. 7 and 8. The second embodiment comprises a driving block (22*a*) formed on an inner track (20*a*) of the rail assembly, a base (30*a*) mounted on the outer track (10*a*) of the rail assembly, a sliding block (40*a*) movably received inside the base (30*a*) and a spring (38*a*) accommodated inside the base (30*a*) to pull the sliding block (40*a*).

The operational process of the second embodiment of the drawer rail with an auto-returning device is the same as shown in the first embodiment, except the configuration of the base (30*a*) is modified to correspond to the outer track (10*a*). The base (30*a*) has further has a pair of wings (303*a*) extending outward from the first end. Each wing (303*a*) has a distal end and a cylinder nub (304*a*) formed at the distal end and clamped between the inner track (20*a*) and the outer track (10*a*) for positioning. Moreover, the base (30*a*) further has a mortise (305*a*) formed at the second end of the base (30*a*) and the outer track (10*a*) further has a tenon (104*a*) correspondingly formed on an inner face to engage with the mortise (305*a*). Thereby, the base (30*a*) is securely attached on the outer track (10*a*).

According to the above description, the drawer rail with an auto-returning device in the present invention has several advantages as follows:

1. The base (30) provides the spring recess (32) and the block recess (34) for guiding the spring (38) and the sliding block (40) to move inside the base (30) so that the elements of the auto-returning device move stably to avoid deforming, mis-aligning and malfunctioning.

2. Various positioning elements such as the spring post (46), the blocking pin (462) formed on the spring post (46), the slit (426) on the sliding block (40), and stub notch (362) defined in the positioning cutout (36) all confirm the connections among elements to make the drawer rail stable and durable.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A drawer rail having an auto-returning device comprising:

a rail assembly composed of an outer track and an inner track;

a driving block formed on the outer track;

a base mounted on the inner track and having a front face, a rear face, a top edge, a bottom edge, a first end, a second end opposite to the first end, wherein the base has a spring recess defined in the front face near the bottom edge at the first end;

a block recess defined in the front face near the bottom edge at the second end to communicate with the spring recess;

an elongated through hole defined in the block recess to penetrate the base; and a positioning cutout defined in the bottom edge beside the block recess and having a stub notch defined in a bottom wall of the positioning cutout;

a sliding block movably mounted inside the block recess of the base and having a front face, a rear face, a top edge, a bottom edge, a first end, and a second end opposite to the first end, wherein the sliding block further has:

an extending portion extending from the rear face at the top edge to penetrate the elongated through hole and having a limiting cutout defined in a top face of the protruding portion for receiving the driving block;

a spring post formed on the rear face near the bottom edge at the second end to insert into the spring recess;

a stub formed on the rear face near the bottom edge at the first end to operationally engage with the stub notch on the base when the sliding block biases;

an inclined face formed on the extending portion at the first end; and a guard wall formed on the extending potion at the top edge of the sliding block; and a slit defined longitudinally in the guard wall to engage with a wall of the elongated through hole to keep the sliding block stable inside the block recess; and a spring accommodated inside the spring recess and having an immovable end attached to the first end of the base and a free end attached to the spring post on the sliding block.

2. The drawer rail having an auto-returning device as claimed in claim 1, wherein the base further has a bumper formed on an inner wall inside the block recess.

3. The drawer rail having an auto-returning device as claimed in claim 2, wherein the base further has two wedges respectively formed on the front face at the first end and the second end of the base; and the inner track further has two mortises defined in the inner track to respectively engage with the two wedges on the base.

4. The drawer rail having an auto-returning device as claimed in claim 3, wherein the spring has a neck formed on the immovable end;

the base further has two opposite inner sidewalls and a pair of cone-shaped nubs respectively formed on the two opposite inner sidewalls to clamp the neck of the spring; and the spring has a hook formed on the free end to engage with the spring post on the sliding block.

5. The drawer rail having an auto-returning device as claimed in claim 4, wherein the stub has an outer periphery and a flat face defined in the outer periphery facing to the second end of the sliding block; and the spring post further has an outer periphery and a blocking pin formed on the outer periphery and perpendicular to the spring post.

6. A drawer rail having an auto-returning device comprising:

a rail assembly composed of an outer track and an inner track, wherein the outer track has a tenon;

a driving block formed on the inner track;

a base mounted on the outer track and having a front face, a rear face, a top edge, a bottom edge, a first end, a second end opposite to the first end, wherein the base has a spring recess defined in the front face near the bottom edge at the first end;

a block recess defined in the front face near the bottom edge at the second end to communicate with the spring recess;

an elongated through hole defined in the block recess to penetrate the base;

a positioning cutout defined in the bottom edge beside the block recess and having stub notch defined in a bottom wall of the positioning cutout;

a pair of wings extending outward from the first end, wherein each one of the pair of wings has a distal end and a cylinder nub formed at the distal end and clamped between the inner track and the outer track for positioning; and a mortise formed at the second end of the base and the outer track to engage with the tenon on the outer track;

a sliding block movably mounted inside the block recess of the base and having a front face, a rear face, a top edge, a bottom edge, a first end, and a second end opposite to the first end, wherein the sliding block further has:

an extending portion extending from the rear face at the top edge to penetrate the elongated through hole and having a limiting cutout defined in a top face of the protruding portion for receiving the driving block;

a spring post formed on the rear face near the bottom edge at the second end to insert into the spring recess;

a stub formed on the rear face near the bottom edge at the first end to operationally engage with the stub notch on the base when the sliding block biases;

an inclined face formed on the extending portion at, the first end;

a guard wall formed on the extending portion at the top edge of the sliding block; and a slit defined longitudinally in the guard wall to engage with a wall of the elongated through hole to keep the sliding block stable inside the block recess; and a spring accommodated inside the spring recess and having an immovable end attached to the first end of the base and a free end attached to the spring post on the sliding block.

7. The drawer rail having an auto-returning device as claimed in claim 6, wherein the base further has a bumper formed on an inner wall inside the block recess.

8. The drawer rail having an auto-returning device as claimed in claim 7, wherein the base further has two wedges respectively formed on the front face at the first end and the second end of the base; and the inner track further has two mortises defined in the inner track to respectively engage with the two wedges on the base.

9. The drawer rail having an auto-returning device as claimed in claim 8, wherein the spring has a neck formed on the immovable end;

the base further has two opposite inner sidewalls and a pair of cone-shaped nubs respectively formed on the two opposite inner sidewalls to clamp the neck of the spring; and the spring has a hook formed on the free end to engage with the spring post on the sliding block.

10. The drawer rail having an auto-returning device as claimed in claim 9, wherein the stub has an outer periphery and a flat face defined in the outer periphery facing to the second end of the sliding block; and the spring post further has an outer periphery and a blocking pin formed on the outer periphery and perpendicular to the spring post.

* * * * *